United States Patent [19]

Wilson et al.

[11] 4,145,044

[45] Mar. 20, 1979

[54] PORTABLE BASKETBALL SET

[75] Inventors: Lowell T. Wilson; Herbert A. Plassmann, both of Bryan, Ohio

[73] Assignee: The Ohio Art Company, Bryan, Ohio

[21] Appl. No.: 774,985

[22] Filed: Mar. 7, 1977

[51] Int. Cl.[2] ..... A63B 63/04

[52] U.S. Cl. ..... 273/1.5 R; 248/188.1; 248/407; 248/519; 403/379; 403/408

[58] Field of Search ..... 273/1.5 R, 1.5 A, 105 R, 273/DIG. 20; 248/407, 519, 523, 408, 188, 524; 403/379, 408

[56] References Cited

U.S. PATENT DOCUMENTS

| | | | |
|---|---|---|---|
| 2,038,806 | 4/1936 | Sellar | 248/407 X |
| 2,194,779 | 3/1940 | Albach | 273/1.5 R |
| 2,379,572 | 7/1945 | Gibson | 273/1.5 R X |
| 3,017,182 | 1/1962 | Chalcroft | 273/1.5 R |
| 3,794,279 | 2/1974 | Kramer | 248/523 |
| 3,841,631 | 10/1974 | Dolan | 273/1.5 R |
| 3,942,904 | 3/1976 | Morris | 403/379 X |

FOREIGN PATENT DOCUMENTS

| | | | |
|---|---|---|---|
| 220166 | 8/1942 | Switzerland | 248/407 |
| 520656 | 4/1940 | United Kingdom | 273/1.5 R |

OTHER PUBLICATIONS

Playthings Magazine, 10–1972, p. 52, Super Puff Ball Basketball Set.

*Primary Examiner*—Paul E. Shapiro
*Attorney, Agent, or Firm*—Hugh Adam Kirk

[57] ABSTRACT

A preschool knock-down portable indoor basketball set comprising a sponge-rubber ball and a weighted vertically adjustable stand for a basket with a removable bounce-board.The weighted base of the stand has an annular socket for one end of a pair of telescopic tubes, adjustable in length by a pin through diametric holes in the tubes. The upper end of the inner telescopic tube has a cap and net ring member, which cap has an annular reinforced socket for the upper tube end, which ring has hidden hooks for suspending a frusto-conical string basket, and intermediate of the cap and ring, has a wedging slot in a vertical plane into which a trapezoidal notch on the lower edge of a bounce-board removably fits.

12 Claims, 6 Drawing Figures

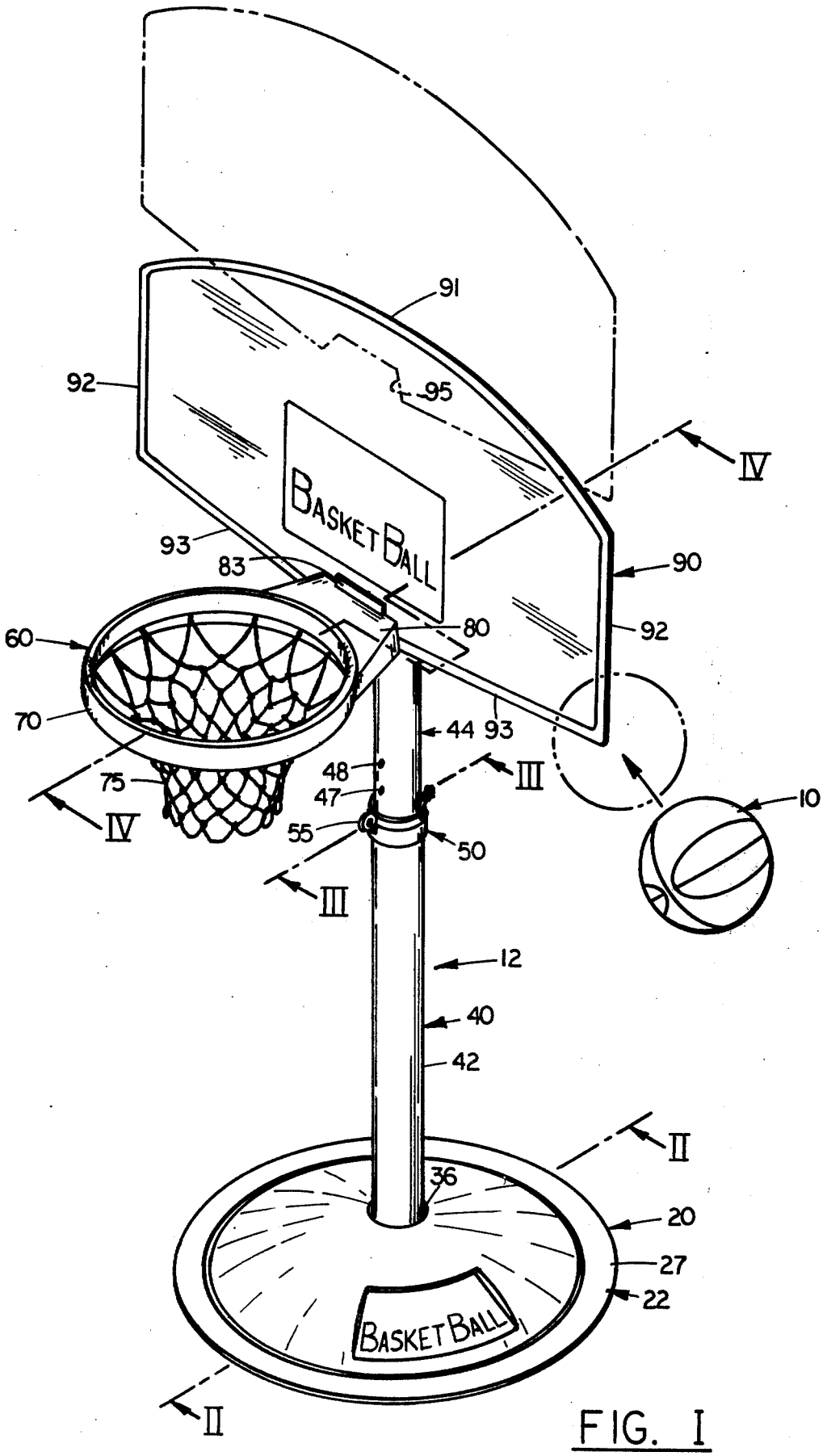
FIG. I

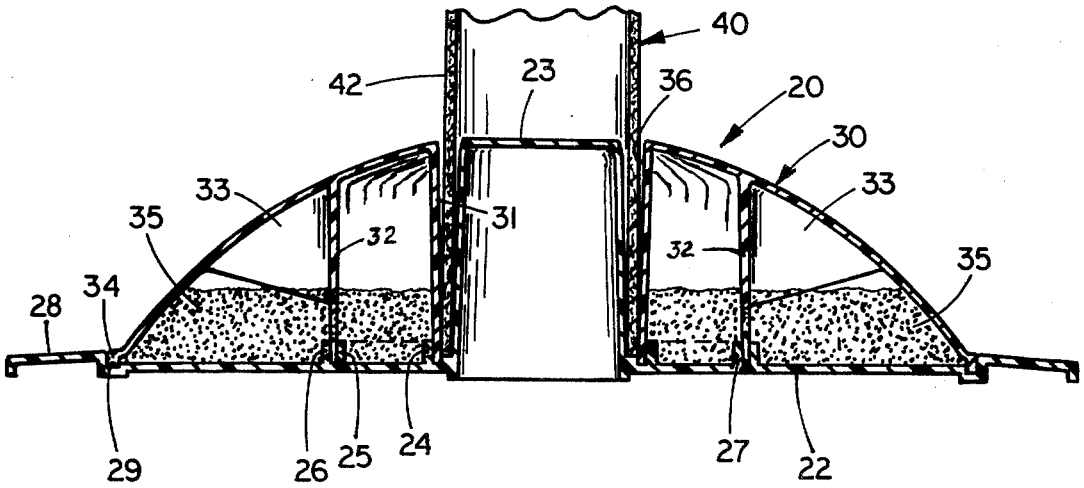
FIG. II
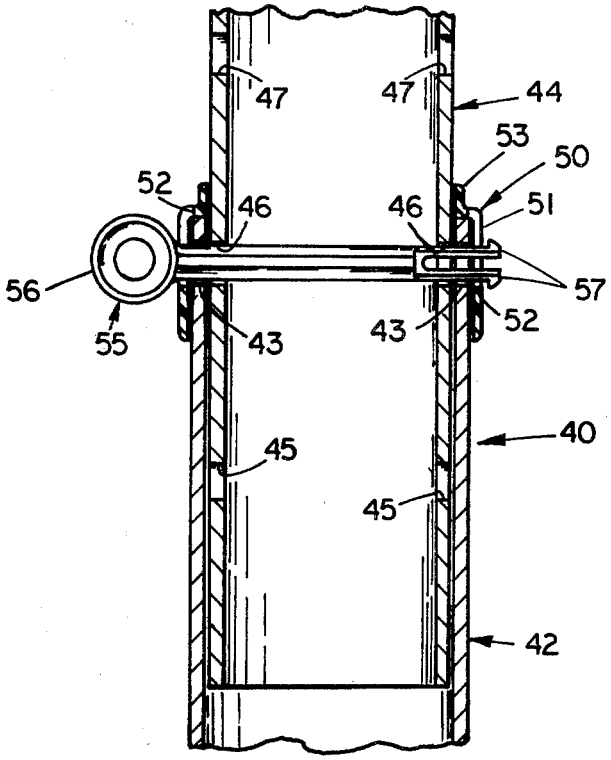
FIG. III

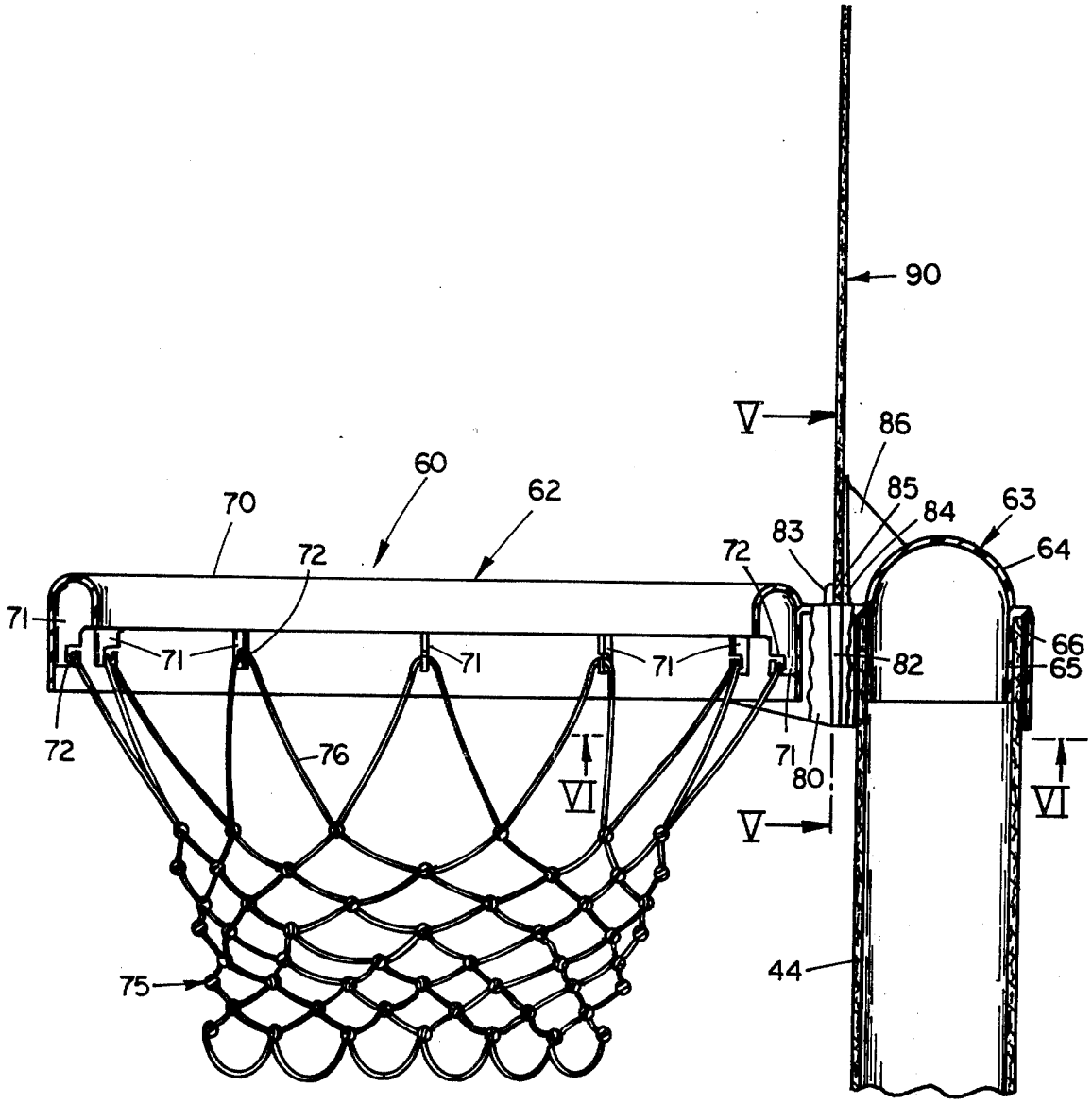
FIG. IV
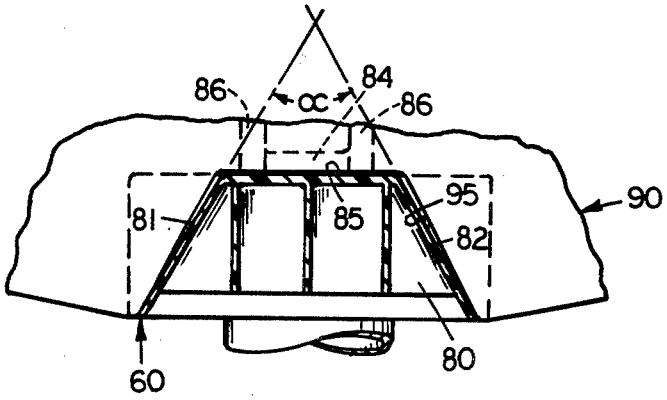
FIG. V

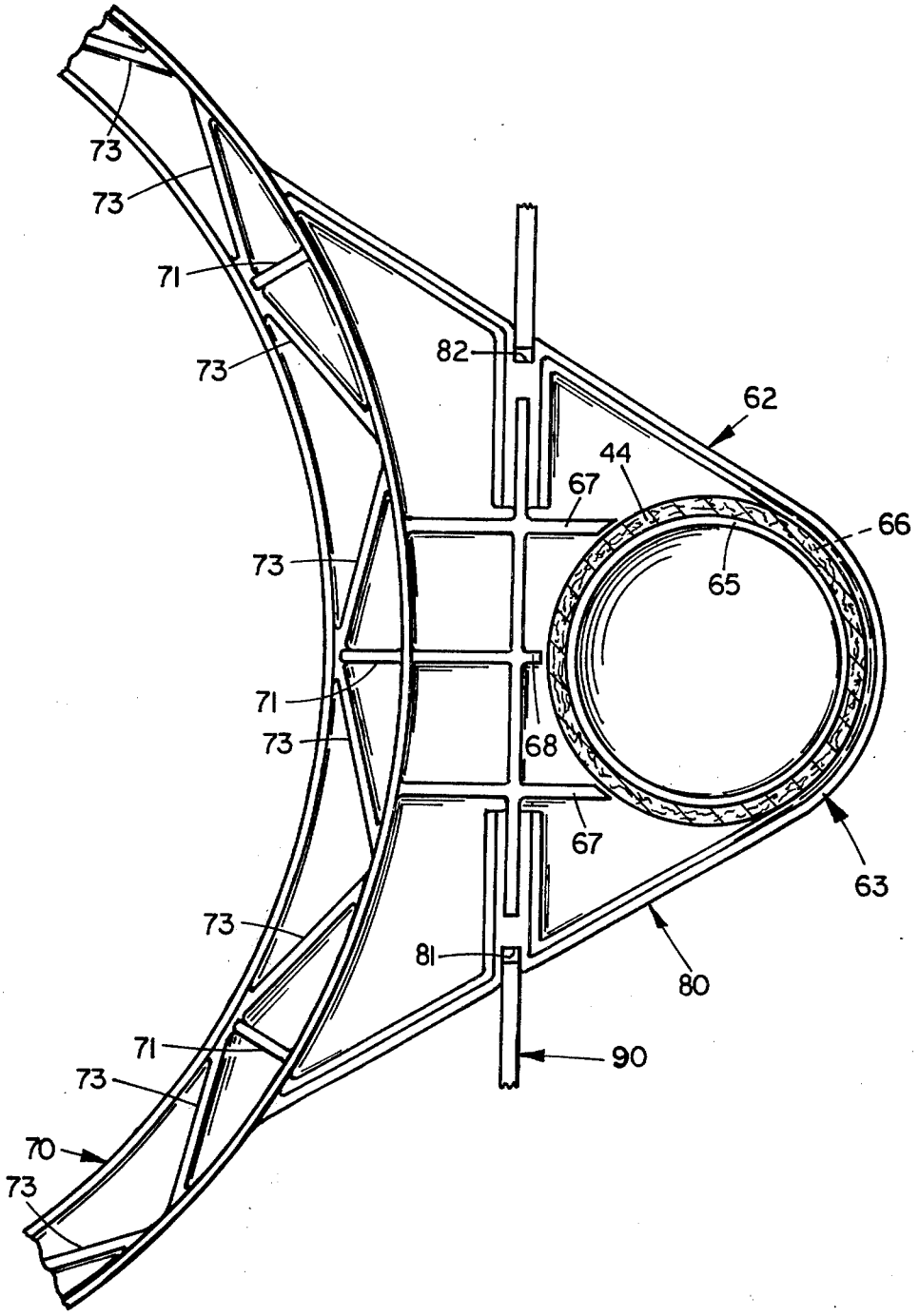
FIG. VI

PORTABLE BASKETBALL SET

BACKGROUND OF THE INVENTION

Previous knock-down portable basketball basket stands were complicated, made out of metal parts, heavy, required tools for assembly, and were not adapted to be played by preschool tots in the living room or the like of a home. Furthermore, prior art basketball stands were of relatively rugged construction and required anchoring and/or rigid assembly, and if they did get knocked over, they could easily damage or injure property and/or persons. Therefore, they were never suitable for portability and play by children in a parlor or a furnished room of a home.

SUMMARY OF THE INVENTION

The present portable knock-down preschool basketball set for use in the home comprises primarily a sponge rubber or soft resilient plastic basketball and a plastic and/or fiberboard relatively light bottom weighted stand for holding the frusto-conical string basket for the ball. In this combination are included several unique features of assembly of the stand which make it both sufficiently rigid for the ball to be bounced against it, but also sufficiently flexible to prevent damage or injury in the event it gets knocked over accidentally. These features include the manufacture of the stand out of plastic and fiberboard tubing and a fiberboard bounce or backboard.

The base of the stand comprises a two-piece hollow spherical-shaped segment with an annular socket in its center, the plug of which socket is molded into a flat disc bottom piece and the periphery of which socket is formed in a cylindrical hole in a dome-shaped reinforced cover piece for the bottom disc piece. This dome preferably is filled with a weighted material such as clean sand or small gravel for stabilizing the pole and basket supported by this base.

The pole for supporting the basket and its bounce-board may comprise a pair of telescoping fiberboard or plastic tubes, an outer longer one of which has its lower end snugly fit into the annular socket in the base, and at its upper end a stepped plastic sleeve or collar for guiding the inner telescoping tube and providing a seat for a diametric hole across the upper end of the outer tube. A resilient plastic cotter-type pin removably fits through the diametrical hole for adjusting the height or extension of the inner tube above the collar by fitting also through one of a plurality of diametric holes spaced longitudinally along the inner tube.

An integral molded plastic cap and ring member have an intermediate neck portion with a transverse trapezoidal wedge-shaped slot or pair of diverging slots on opposite sides of the neck for supporting the bounce or backboard. The cap portion of this member is provided with a reinforced annular socket for the upper end of the smaller inner and/or shorter telescopic tube. The adjacent ring for the basket or net has an inverted U-shaped radial cross-section with equally angular spaced plurality of ribs having hooks formed therein against the outer rim or leg of the cross-section, into which hooks are fastened the upper loops of a frusto-conical string net or basket which depends from the ring for retarding the descent of the ball once it is thrown or dropped into the ring. The bottom of the "U" of the U-shaped cross-section of the ring is also preferably reinforced by a plurality of angular chord-type ribs molded therein, as is the neck portion of this member which contains the slots for supporting the backboard. Above and adjacent the cap there are also provided a pair or more of upstanding flanges or brackets for further guiding, supporting, and maintaining the backboard in a vertical position once it is placed in the wedge slots provided therefor in the neck portion.

The bounce or backboard preferably comprises an oblong piece of fiberboard with an arcuate top and tapered bottom with a centrally located trapezoidal notch to fit into the notch in the neck portion of the cap and ring member. The wedging or converging taper of the slots grip the outer edges of the trapezoidal notch in the board while the divergent taper of the sides of the notch in the neck portion permit the board to be easily knocked out of its slot in the event the stand tips over in the plane of the backboard so that the edge of the backboard will break away from its seat and also break the fall of the stand.

Accordingly, it is an object of this invention to produce an efficient, simple, effective, economical, lightweight, safe, knock-down and portable basketball set for preschool children which can be played indoors in a furnished home without damage either to the furniture in the home or injury to the children playing with the set.

BRIEF DESCRIPTION OF THE VIEWS

The above mentioned and other features, objects and advantages, and a manner of attaining them are described more specifically below by reference to an embodiment of this invention shown in the accompanying drawings, wherein:

FIG. I is a perspective view of the basketball set according to the present invention in its assembled position showing the ball moving toward the basket and in dot-dash lines how the backboard can be removed from its position;

FIG. II is an enlarged sectional view taken along line II—II of the base shown in FIG. I;

FIG. III is an enlarged sectional view taken along line III—III in FIG. I of the junction between the telescopic tubes forming the pole of the stand showing the cotter pin therein;

FIG. IV is an enlarged sectional view taken along line IV—IV of FIG. I showing the cap and ring assembly and wedge-shaped slot for supporting the backboard;

FIG. V is a sectional view taken along line V—V of FIG. IV showing the trapezoidal shape of the notch in and slots for the backboard;

FIG. VI is an enlarged sectional view taken along line VI—VI of FIG. V showing the integrally molded reinforcing ribs in the cap and neck member.

DETAILED DESCRIPTION OF PREFERRED EMBODIMENT

Referring first generally to FIG. I, there is shown the spongerubber basketball 10 which may have grooves or a pattern thereon to resemble the seams of a real basketball, and a basket stand 12 having a base portion 20, a pole portion 40, a basket portion 60 and a bounce or backboard portion 90. All of these portions are easily assembled and disassembled and may be packaged in a single carton whose length is slightly greater than the longest section of the pole portion, whose width is slightly greater than the diameter of the base portion 20, and whose thickness is slightly greater than the diameter of the ball 10.

1. The Base

Referring now specifically to FIG. II, the base portion 20 herein comprises a circular disc portion 22 having a central integral cylindrical plug portion 23 around which plug 23 are expanding concentric circular ribs 24, 25 and 26, providing seats including an annular groove 27, and an outer peripheral annular ring flange 28 having an annular groove 29 around its inner periphery. The annular spherical segment or dome-shaped portion 30 of the base 20 is provided with a cylindrical central wall portion 31 for fitting or seating inside the rib 24, and an intermediate cylindrical wall 32 for fitting or seating into the annular groove 27. This cylindrical wall 32 may be equally angularly reinforced by webs 33 molded integrally with the dome portion 30. The outer peripheral edge of the dome portion 30 is provided with a downwardly projecting annular flange 34 which fits into the groove 29. In the space between the webs 33 and the cylindrical walls 31 and 32, there is provided a material for weighting the base 20, such as washed sand or gravel 35. When this weighting material is placed in the dome portion 30, the two portions 22 and 30 are fastened together such as by an adhesive or a solvent for fusing the lower annular ends of the walls 31, 32 and 34 into their seats provided by the annular grooves 27 and 29 and ribs 24, 25 and 26. This assembly then provides an annular socket 36 between the concentric cylindrical walls of the plug 23 and wall 31 into which the lower end of the larger tubular pole portion 42 snugly fits. If desired, this annular socket 36 may be slightly tapered inwardly toward its lower end for better anchoring the pole portion 42.

2. The Pole

Referring to FIGS. I and III, the pole portion herein is shown to comprise a pair of telescopic tubes 42 and 44 surrounded at the upper end of the lower longer and larger tube 42 with a stepped collar 50 having a larger cylindrical portion 51 with diametrically aligned apertures 52 therein, and a smaller cylindrical portion 53 for guiding the smaller telescoping tube 44. Aligned with the apertures 52 in the collar 50 are diametrically aligned apertures 43 near the upper end of the larger tube 42, and also a plurality of diametrically aligned apertures 45, 46, 47 and 48 at axially spaced intervals along the smaller telescoping tube 44. For anchoring the telescopic tubes 42 and 44 in different extended positions, there is provided a plastic cotter-type pin 55 which extends diametrically through the holes 52 in the stepped sleeve 50 and aligned holes 43 of the lower tube 42 and one of the selected diametrically opposite aligned holes 45 through 48 in the smaller telescoping tube 44. The plastic cotter pin 55 preferably is reinforced by having a cross-shaped cross-section with a finger gripping ring 56 at its one end and resilient parallel tines 57 at its other end, which tines may be provided with outwardly extending knobs or steps at their outer ends to prevent the pin 50 from sliding out of its locking position shown in FIG. III, but still due to the resiliency of the plastic, the pin 55 may be pulled out of the diametrical holes therefor by camming together of the knob ends by the tines 57 against the edge of the aperture 52 in the sleeve 50.

These tubular sections 42 and 44 may be made of plastic or of cardboard mailing-type tubing, and may be decorated on the outside as desired, as can the upper outer side of the dome portion 30 of the base 20.

3. The Cap and Ring

Referring now to FIGS. IV, V and VI, there is disclosed the cap and ring member 60 comprising a ring portion 62 and a cap portion 63 for fitting over the upper end of the smaller telescoping tube 44 and an intermediate neck portion 80.

The cap portion 63 as shown in FIGS. IV and VI comprises a closed hemicircular dome 64 and inside thereof a concentric cylindrical portion 65 which fits inside of the upper end of the tubular section 44 and provides a semi-annular slot portion 66 between the cylindrical portion 65 and the inside of the adjacent end of the unit 62. Opposite this semiannular slot 66 are provided a plurality of ribs 67 and 68, the outer ends of which form guides for the outside of the upper end of the tubular section 44.

The ring portion 62 comprises an inverted annular channel 70 of a U-shaped radial cross-section, bridged by integral radial webs 71 which depend below the shorter leg of the U-shaped cross-section to expose hook slots 72 for attachment of the upper ring of loops 76 of the frusto-conical string basket or net 75. In order to prevent too much flexing of the ring 70, it may be further reinforced by the angular chord-type webs 73 as shown in FIG. VI between each of the radial ribs 71 and between the two legs or in the base of the "U" of the inverted U-section of this ring channel 70.

The neck portion 80 between the ring 70 and cap 63 is provided with a pair of diverging slots 81 and 82 as shown in FIG. V, the apex angle $\alpha$ of which may vary between 30 and 60 degrees and preferably closer to 30 degrees to increase the stability of the board 90 fitted therein. However, the greater this angle $\alpha$, the easier the board 90 will be knocked out of its position to prevent damage in case the stand tips over and the outer edge of the board 90 hits against an object. These slots are also downwardly converging or wedge-shaped as shown at 82 in FIG. IV. Further in support of the board 90, there is provided in the neck portion 80 a pair of upstanding parallel flange portions 83 and 84 for further defining the horizontal portion of a slot 85 bridging the upper ends of the two diverging tapered or wedge-shaped slots 81 and 82 to form a sort of trapezoidal-shaped slot around the neck portion 80. Further, for reinforcing and supporting the backboard 90, there also may be provided a pair of parallel brackets 86 projecting upwardly from the flange portion 84 and integrally formed with this neck portion 80 and braced by webs bridging from the top 64 of the cap portion 63.

4. The Bounceboard

The bounce or backboard portion 90 is preferably made out of a fiberboard which may be impregnated with a plastic, or it may be made out of plastic, and is substantially oblong in shape, having rounded corners and a convex upper edge 91, parallel vertical sides 92, and converging bottom edges 93 centrally and between which is provided a trapezoidal-shaped notch 95 as shown in FIGS. I and V for fitting into the trapezoidal-shaped slot in FIG. V with wedging side notches 81 and 82. The large front and back surfaces of the backboard 90 also may be decorated, if desired.

In the knocked-down position, the post portion 40 is removed from the socket 36 in the base portion 20. The post portion 40 may then be disassembled by removing the pin 55 and slipping the tube 44 inside or completely outside of the tube 42, and also removing the collar or sleeve 50. The ring and cap member 60 may have its cap portion 63 removed from the upper end of the tube 44, the back plate 90 may be removed out of its trapezoidal-shaped slot 81, 82 and 85, and if desired, loops 76 of the net 75 may be removed from the hooks 72. All of this disassembly and assembly may be performed according to easy instructions and without the addition of tools. Thus, since all of the parts of the basketball set and particularly the stand portion 12 thereof are easily slipped together by means of friction, it can be easily knocked down and if knocked over, can readily fall apart to break its fall rather than damaging any of the furniture or objects it may hit, as well as avoid injuring any children that may be in its way. Furthermore, since it is very light, except for the weighted base, there is substantially no danger of any injury occuring with the normal playing with this set.

While there is described above the principles of this invention in connection with specific apparatus, it is to be clearly understood that this description is made only by way of example and not as a limitation to the scope of this invention, in that other materials may be used than those specifically disclosed, provided they have the desirable properties. Also different reinforcements can be employed in the parts depending upon the type of materials used. Furthermore, some of the parts which are integral can be made separate, and vice versa, without departing from the scope of this invention.

We claim:

1. A basketball set comprising:

(A) a resilient foam plastic ball, and (B) a basket stand comprising:

1. a weighted base having an annular socket therein,
2. a vertical tubular pole member with its lower end fitting into said socket,
3. means for adjusting the length of said pole member,
4. means having a socket for fitting the upper end of said pole member, a horizontal adjacent ring with hook means, and a slot means in a vertical plane between said socket and said ring,
5. a flexible net attached to said hook means and forming a receiver for said ball below said ring,
6. a vertical bounceboard having a notch in its lower edge for fitting into said slot means.

2. A set according to claim 1 wherein said means for adjusting the length of said pole portion comprises a pair of telescoping tubes and resilient pin means for extending through diametrically aligned apertures in said tubes.

3. A set according to claim 2 including a stepped ring means between the upper end of the lower one of said tubes and having diametrically aligned openings for said pin means, and said inner telescopic tube having a plurality of axially spaced diametrical openings.

4. A set according to claim 1 wherein said ring has an inverted U-shaped radial cross-section with radial and longitudinal reinforcing web portions.

5. A set according to claim 4 wherein said radial flanges are provided with said hook means.

6. A set according to claim 1 wherein said slot means is trapezoidal.

7. A set according to claim 6 wherein said slot means is extended by a pair of parallel upstanding flanges.

8. A set according to claim 6 wherein the diverging sides of said trapezoidal slot are wedged shaped slots.

9. A set according to claim 6 including an upstanding bracket means aligned with said slot means for further supporting said bounceboard.

10. A stand for a ball set comprising:

(A) a weighted base having an annular socket, said base comprising: a pair of plastic disc-shaped members, one of which is flat having a central cylindrical upstanding plug portion and the other of which is a spherical segment dome having an axial cylindrical aperture of larger diameter than said plug portion for forming an annular socket between said plug and said aperture, and (B) a post having a vertical tubular end which seats in said socket.

11. A stand according to claim 10 wherein the space between said spherical segment dome and said flat member contains a weight-producing material.

12. A toy basketball assembly set comprising:

(A) a foam rubber ball, and (B) a basket stand comprising:

1. a weighted base having an annular socket,
2. telescopic vertical tubes, one end of one of which seats into said socket, at least one of said tubes having a plurality of axially spaced diametrically alignable holes,
3. a pin means for fitting in said diametrically aligned holes for fastening the length of said tubes,
4. a tube cap and ring member capping the other end of said tubes, having a horizontal reinforced ring with a plurality of radially inwardly extending hooks, and having upwardly converging wedge slots in a vertical plane between said cap and said ring,
5. a frusto-conical string net attached at its larger diameter end to said hooks to depend from said ring, and
6. a vertical bounceboard having a trapezoidal notch in its central lower edge for removably fitting into said slots in said cap and ring member.

* * * * *